US006102502A

United States Patent [19]

Melillo et al.

[11] Patent Number: 6,102,502

[45] Date of Patent: Aug. 15, 2000

[54] MERCHANDISING UNIT WITH DOOR DISPLAY

[75] Inventors: Timothy Melillo, Middlefield; Paul Graham, Warren, both of Ohio

[73] Assignee: Kraftmaid Cabinetry, Inc., Middlefield, Ohio

[21] Appl. No.: 09/166,650

[22] Filed: Oct. 5, 1998

Related U.S. Application Data

[60] Provisional application No. 60/075,320, Feb. 20, 1998.

[51] Int. Cl.[7] ..... A47B 81/00

[52] U.S. Cl. ..... 312/234; 312/136; 312/304; 211/41.16

[58] Field of Search ..... 312/234, 114, 312/132, 128, 136, 304, 305, 324, 140, 351; 434/72, 80, 365; 211/41.16, 41.15, 169

[56] References Cited

U.S. PATENT DOCUMENTS

| | | | |
|---|---|---|---|
| 569,367 | 10/1896 | Wood | 211/169 X |
| 965,099 | 7/1910 | Forgy | 211/41.16 |
| 1,416,409 | 5/1922 | Miner | 211/169 X |
| 1,841,620 | 1/1932 | McCoy | 312/234 |
| 2,221,766 | 11/1940 | Harris et al. . | |
| 2,339,627 | 1/1944 | Edison | 312/304 |
| 2,575,567 | 11/1951 | Swartz | 312/304 |
| 3,732,633 | 5/1973 | Margolis et al. | 312/234 X |
| 3,760,952 | 9/1973 | White | 312/136 X |
| 3,897,855 | 8/1975 | Patterson | 312/234 X |
| 4,102,458 | 7/1978 | Fors . | |
| 4,135,315 | 1/1979 | McKee . | |
| 4,339,164 | 7/1982 | Spevak | 312/283 |
| 5,160,050 | 11/1992 | Russo | 211/169 X |
| 5,368,486 | 11/1994 | Kurzman | 434/80 X |
| 5,405,193 | 4/1995 | Herrenbruck | 312/118 |
| 5,740,910 | 4/1998 | Ueng | 211/169 X |

*Primary Examiner*—Peter M. Cuomo
*Assistant Examiner*—Hanh V. Tran
*Attorney, Agent, or Firm*—Edgar A. Zarins; Lloyd D. Doigan

[57] ABSTRACT

A merchandising unit for the display of consumer products particularly cabinetry components. The unit includes a plurality of cabinet door samples allowing the consumer to examine the individual doors. The doors are pivotably mounted within the unit along parallel axes facilitating full examination. The merchandising unit also includes a section for displaying the various hardware offerings and a lower section displaying base cabinetry and drawers. All of these features allow the consumer to directly examiner the cabinetry components for making an informed purchase.

15 Claims, 2 Drawing Sheets

MERCHANDISING UNIT WITH DOOR DISPLAY

This application claims the benefit and priority of U.S. Provisional Patent Application Ser. No. 60/075,320 filed on Feb. 20, 1998.

BACKGROUND OF THE INVENTION

I. Field of the Invention

This invention relates to a merchandising unit for displaying components of cabinetry and, in particular, to a cabinetry merchandising unit which incorporates detailed display of cabinet components including pivoting display of cabinet door samples allowing prospective purchasers to comparatively view the multitude of door offerings.

II. Description of the Prior Art

Prior known merchandising units have been severely limited as to the component variations which can be presented to the consumer. Merchandise such as cabinetry can come in numerous styles while the prior known merchandising kiosks can display only a handful of the more popular styles. Retail establishments have limited space to dedicate to individual product displays. Yet the consumer would prefer an actual sample of the product offerings to make an informed decision concerning their purchase.

Currently, the most popular method of merchandising cabinetry is through kiosks which display a limited number of cabinet door samples. Although consumers are provided the opportunity to manipulate the cabinet doors, the size limitations of the kiosk display allow the display of only the more popular door styles in limited finishes. Furthermore, because of the importance of the cabinet door style to the consumer, these kiosks provide little or no hands-on information concerning hardware or the construction of the cabinetry and their drawers.

SUMMARY OF THE PRESENT INVENTION

The present invention overcomes the disadvantages of the prior known merchandising unit by providing a system for displaying the available components of cabinetry including the various door styles, hardware and construction features.

The merchandising unit of the present invention includes sections for providing the consumer with hands-on samples of the components which comprise typical kitchen and bath cabinet installations. This includes the cabinet drawers and their hardware, exterior hardware for the cabinets, base cabinets and samples of the variety of door styles and finishes available to the consumer. A lower section of the unit includes sample drawers and base cabinets. An intermediate section displays cabinet hardware and may include promotional or instructional information related to the cabinets. An upper section of the merchandising unit includes a plurality of cabinet door samples. The doors are pivotably mounted along parallel axes to permit the consumer to fully view both sides of the door. Each door may be fully viewed by flipping the individual doors creating a gap between adjacent doors. Product information could be provided on the back side of each door panel.

Thus, the present invention provides a convenient system for displaying to potential consumers the variety of selections in a cabinet system. The pivotable display of cabinet doors provides the consumer with the means to examine the styling, finish and construction of individual doors. This eliminates the uncertainty associated with choosing cabinetry through photographs in a catalog. The merchandising system also facilitates immediate substitution of styles by replacing discontinued door styles with new styles or adding new hardware.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
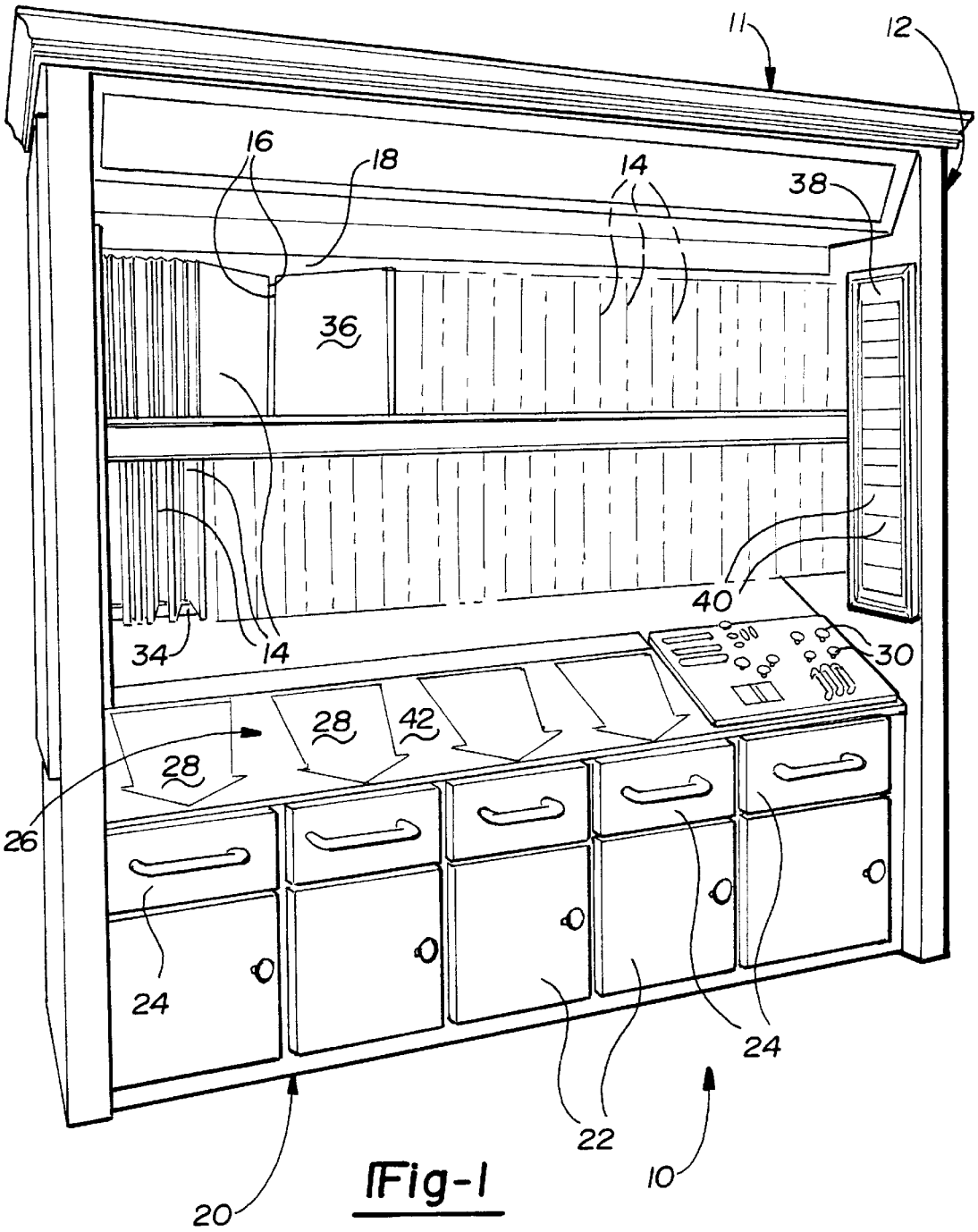
FIG. 1 is a perspective view of a merchandising unit embodying the present invention.
Figure 2:
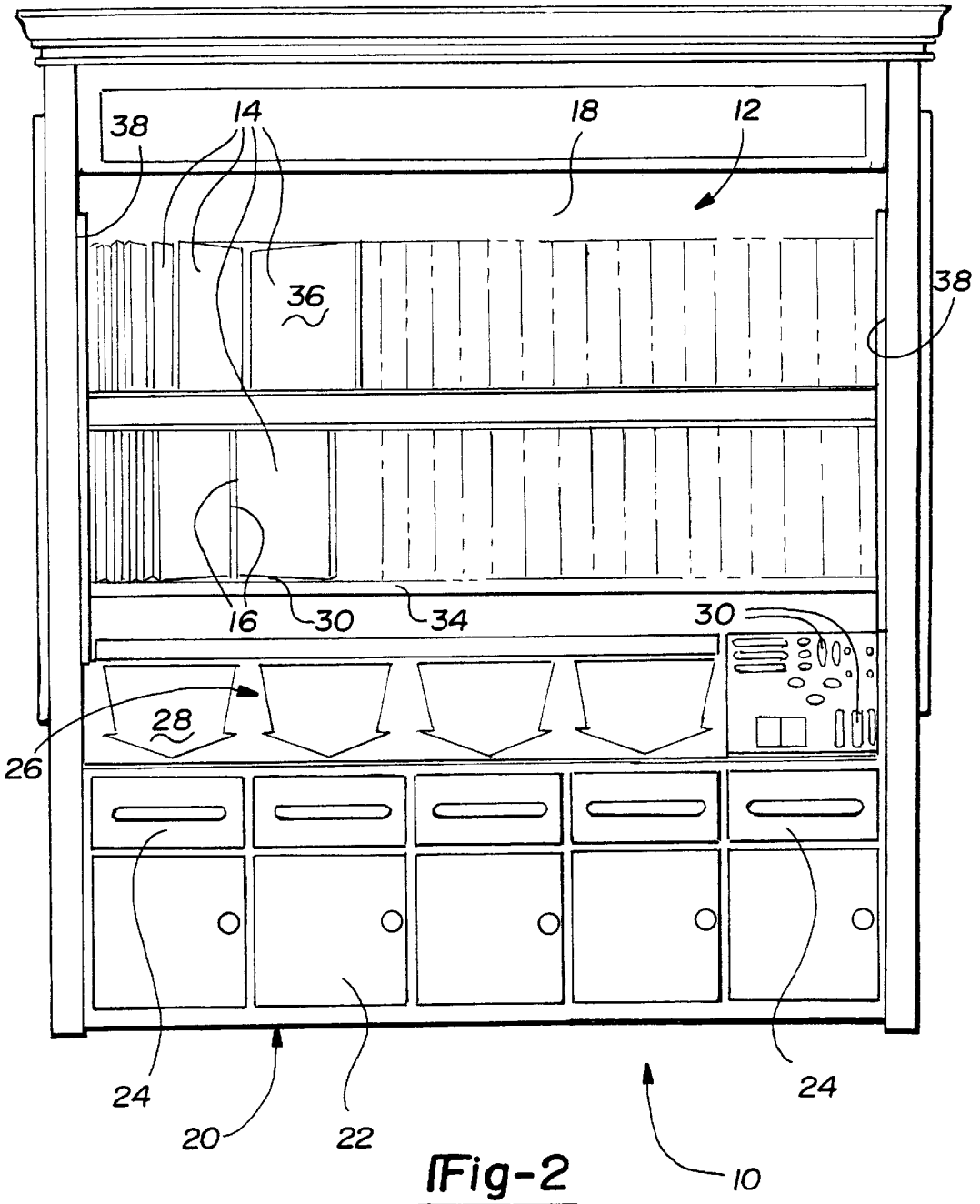
FIG. 2 is a front elevational view.

Referring to the drawing, there is shown a merchandising unit 10 adapted to market kitchen and bath cabinetry providing hands-on examination by potential consumers. The merchandising unit 10 is adapted for use in home centers, kitchen and bath centers and possibly even hardware stores to display the variety of door styles, finishes and construction features available to consumers. The compact configuration of the merchandising unit 10 facilitates the display of a multitude of components in an acceptable space.

The merchandising unit 10 has a housing 11 which includes an upper section 12 displaying a plurality of sample products 14. The samples 14 are pivotably mounted within the upper section 12 to allow viewing of both sides of each sample 14. The samples 14 are pivotably mounted along a rear edge 16 such that the pivot axes of the samples 14 are parallel along a rear wall 18 of the upper section 12. In a preferred embodiment, the samples 14 are cabinet doors allowing the consumer to fully evaluate the style, finish and construction of the various doors offered by the manufacturer.

A lower section 20 of the merchandising unit 10 includes base cabinets 22 including preferably drawers 24. This allows the consumer to examine the construction of the base cabinets 22 including convenience features and hardware.

An intermediate section 26 of the unit may be used to provide consumer information 28 or the variety of hardware 30 available from the manufacturer. The upper section 12 of the unit 10 is designed to allow consumers to fully examine the different door styles and finishes offered by a cabinet maker. In a preferred embodiment, each of the cabinet door samples 14 is pivotably mounted to the rear wall 18 through pivot pins 30 secured to the rear edge 16. The pivot pins 30 are received within apertures 32 formed in parallel rails 34 secured to the rear wall 18. As a result, each individual door sample 14 may be manipulated by the consumer to examiner the styling and finish. Additionally, product information may be provided on a back panel 36 of the door 14. The pivoting display of the door 14 allows dozens of samples to be displayed in a compact area.

In addition to the finishes displayed on the sample doors 14, side panels 38 proximate the door display 12 may incorporate additional finish samples 40 on the various wood types used in the manufacture of cabinets. This information in connection with the door samples 14 provides the consumer with sufficient information to make a knowledgeable choice of cabinet.

The lower section 20 of the display unit 10 provides base cabinet 22 samples to further aid the consumer in choosing a specific construction and additional features. In a preferred embodiment, a plurality of base cabinets 22 and drawers 24 are included in the lower section 20. Each of these individual base cabinets has a different construction, such as dowled or dovetail assembly, allowing the consumer to directly examine the construction features. A panel 42 directly above the base cabinets 22 can be used to point out the features of the individual base cabinets 22.

The intermediate section 26 also provides a convenient means of displaying available cabinet hardware 30. Drawer pulls, door knobs, door handles and hinges may be mounted to the intermediate section 26 for convenient comparison by the consumer.

Thus, the merchandising unit 10 of the present invention provides the consumer with a convenient system for choosing a cabinet style, finish, construction and even the decorative hardware. The consumer will have the ability to manipulate and closely examine numerous door styles and finishes to make an informed choice. Additionally, the cabinet construction can be examined by the consumer. All of these features allow the consumer to have installed the desired cabinet collection.

The foregoing detailed description has been given for clearness of understanding only and no unnecessary limitations should be understood therefrom as some modifications will be obvious to those skilled in the art without departing from the scope and spirit of the appended claims.

What is claimed is:

1. A merchandising unit comprising:

a housing having a first section with a plurality of door panels aligned side by side across said first section, each of said door panels independently pivotably mounted on parallel axes vertically aligned in side by side arrangement within said first housing section for independent pivotable manipulation of said door panels;

a second housing section for displaying at least one fixedly mounted base cabinet, said at least one base cabinet having a retractable drawer and a pivotable door selectively manipulable for inspection of said at least one base cabinet; and an intermediate section disposed between said first housing section and said second housing section wherein at least a portion of said intermediate section includes a display panel with cabinet hardware secured thereto.

2. The merchandising unit as defined in claim 1 wherein said first housing section is disposed above said second housing section, said first and second housing sections extending transversely across said housing.

3. The merchandising unit as defined in claim 1 wherein each of said panels includes pivot pins for pivotably mounting said panels in side by side pivotable arrangement to spaced apart rails secured to a rear wall of said first housing section, each of said panels independently manipulable for examination of both sides of each panel.

4. The merchandising unit as defined in claim 3 wherein said first housing section includes a pair of rows of pivotable panels, each of said panels laterally pivotable.

5. The merchandising unit as defined in claim 1 wherein said at least one fixedly mounted cabinet of said second housing section includes at least one cabinet door in conjunction with at least one retractable cabinet drawer.

6. The merchandising unit as defined in claim 5 wherein said pivotable panels are cabinet door samples.

7. A merchandising unit comprising:

a housing having a first section with a plurality of panels aligned across said first section, each of said panels independently pivotably mounted within said first housing section of independent pivotable manipulation;

a second housing section for displaying at least one fixedly mounted cabinet, said at least one cabinet having a retractable drawer and a pivotable door selectively manipulable for inspection of said at least one cabinet; and a third housing section intermediate said first and second housing sections and having a fixed display panel with a plurality of cabinet hardware secured thereto for display.

8. The merchandising unit as defined in claim 7 wherein said first housing section is disposed above said second housing section, said third housing section forming an intermediate section disposed between said first and second housing sections.

9. The merchandising unit as defined in claim 7 wherein each of said panels includes pivot pins for pivotably mounting said panel to spaced apart rails secured to a rear wall of said first housing section, each of said panels independently manipulable for examination of both sides of each panel.

10. The merchandising unit as defined in claim 9 wherein said first housing section includes a pair of rows of pivotable panels, each of said panels laterally pivotable.

11. The merchandising unit as defined in claim 7 wherein said at least one fixedly mounted cabinet of said second housing section includes at least one cabinet door in conjunction with at least one retractable cabinet drawer.

12. A merchandising unit comprising:

a first upper section with a plurality of door panels, each of said door panels pivotable mounted on a corresponding plurality of parallel axes vertically aligned in side by side arrangement within said first housing section such that said door panels are independently pivotable for display;

a second lower section having at least one cabinet, said at least one cabinet selectively manipulable for inspection for said at least one cabinet; and a third intermediate section disposed between said upper and lower sections, said intermediate section including a fixed display panel having a plurality of cabinet hardware secured thereto for display.

13. The merchandising unit as defined in claim 12 wherein each of said panels includes pivot pins for pivotably mounting said panel to spaced apart rails secured to a rear wall of said first housing section, each of said panels independently manipulable for examination of both sides of each panel.

14. The merchandising unit as defined in claim 13 wherein said first housing section includes a pair of rows of pivotable panels, each of said panels laterally pivotable.

15. The merchandising unit as defined in claim 12 wherein said at least one fixedly mounted cabinet of said second housing section includes at least one cabinet door in conjunction with at least one retractable cabinet drawer.

* * * * *